US010524047B2

(12) United States Patent
Cho et al.

(10) Patent No.: US 10,524,047 B2
(45) Date of Patent: Dec. 31, 2019

(54) SATELLITE MICROPHONE ASSEMBLY

(71) Applicant: Cisco Technology, Inc., San Jose, CA (US)

(72) Inventors: Matthew M. U. Cho, Fremont, CA (US); Ian Matthew Snyder, San Francisco, CA (US); Morgan Davis Teachworth, Campbell, CA (US); Nicholas James Kaoru Kawamoto, Novato, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 15/948,829

(22) Filed: Apr. 9, 2018

(65) Prior Publication Data

US 2019/0313185 A1 Oct. 10, 2019

(51) Int. Cl.
*H04R 3/00* (2006.01)
*H04R 1/08* (2006.01)

(52) U.S. Cl.
CPC ..... *H04R 3/00* (2013.01); *H04R 1/08* (2013.01); *H04R 2430/01* (2013.01)

(58) Field of Classification Search
CPC ..... H04R 3/00; H04R 1/08
See application file for complete search history.

(56) References Cited

U.S. PATENT DOCUMENTS 9,793,869 B1 * 10/2017 Snyder ..... G01D 5/3473
2005/0286443 A1 * 12/2005 McMillen ..... H04M 3/56 370/260
2009/0079712 A1 * 3/2009 Levin ..... G05G 9/047 345/184
2013/0177191 A1 * 7/2013 Waguri ..... H04R 5/027 381/356
2017/0003705 A1 * 1/2017 Yamaguchi ..... F16F 13/02

FOREIGN PATENT DOCUMENTS

CN 102655583 9/2012
CN 204331453 5/2015

OTHER PUBLICATIONS

Averusa, "Interactive Video Conferencing K-12 applications," "Interactive Video Conferencing K-12 applications" copyright 2012. http://www.averusa.com/education/downloads/hvc brochure goved.pdf (last accessed Oct. 11, 2013).
Clauser, Grant, et al., "Is the Google Home the voice-controlled speaker for you?," The Wire Cutter, Nov. 22, 2016, pp. 1-15.

* cited by examiner

*Primary Examiner* — David L Ton
(74) *Attorney, Agent, or Firm* — Polsinelli PC

(57) ABSTRACT

A satellite microphone assembly formed by a base housing a microphone and a volume control electronics and an outer ring coupled with the base and rotatable about the base. The outer ring includes a center aperture having an actuatable button to toggle mute/unmute of the microphone disposed therein. A rotational sensor is supported by the base and configured to detect a rotation of the outer ring and to output information about a direction and a degree of rotation of the outer ring to the volume control electronics, thereby causing a rotation of the outer ring to affect a volume of a speaker.

14 Claims, 6 Drawing Sheets

SATELLITE MICROPHONE ASSEMBLY

TECHNICAL FIELD

The present technology relates to conference equipment, and more specifically to a satellite, or remote, microphone for a speakerphone.

BACKGROUND

Satellite microphones are commonly used in teleconferencing hardware, such as speakerphones and conference room audio equipment, and are connected to a base station of the speakerphone or multiplexer/controller of conference room audio equipment. Whereas microphones provided in the base station of the teleconferencing hardware may be far from some participants in a call, satellite, or remote, microphones improve the voice quality of a call by placing the microphone closer to a user, thereby yielding a better signal to noise ratio.

Satellite microphones might provide a mute function via a discrete button on the surface of the wired satellite microphone, which allows a participant to turn off his or her microphone at will (or even all of the microphones connected to the teleconferencing hardware), and remove his or her audio stream from the call. However, the mute button is often small or hard to locate, particularly for a user unfamiliar with a given wired satellite microphone. Furthermore, while wired satellite microphones may offer a mute function, they do not offer any physical way to control the volume level of a speaker(s).

DESCRIPTION OF EXAMPLE EMBODIMENTS

Overview

Figure 1:
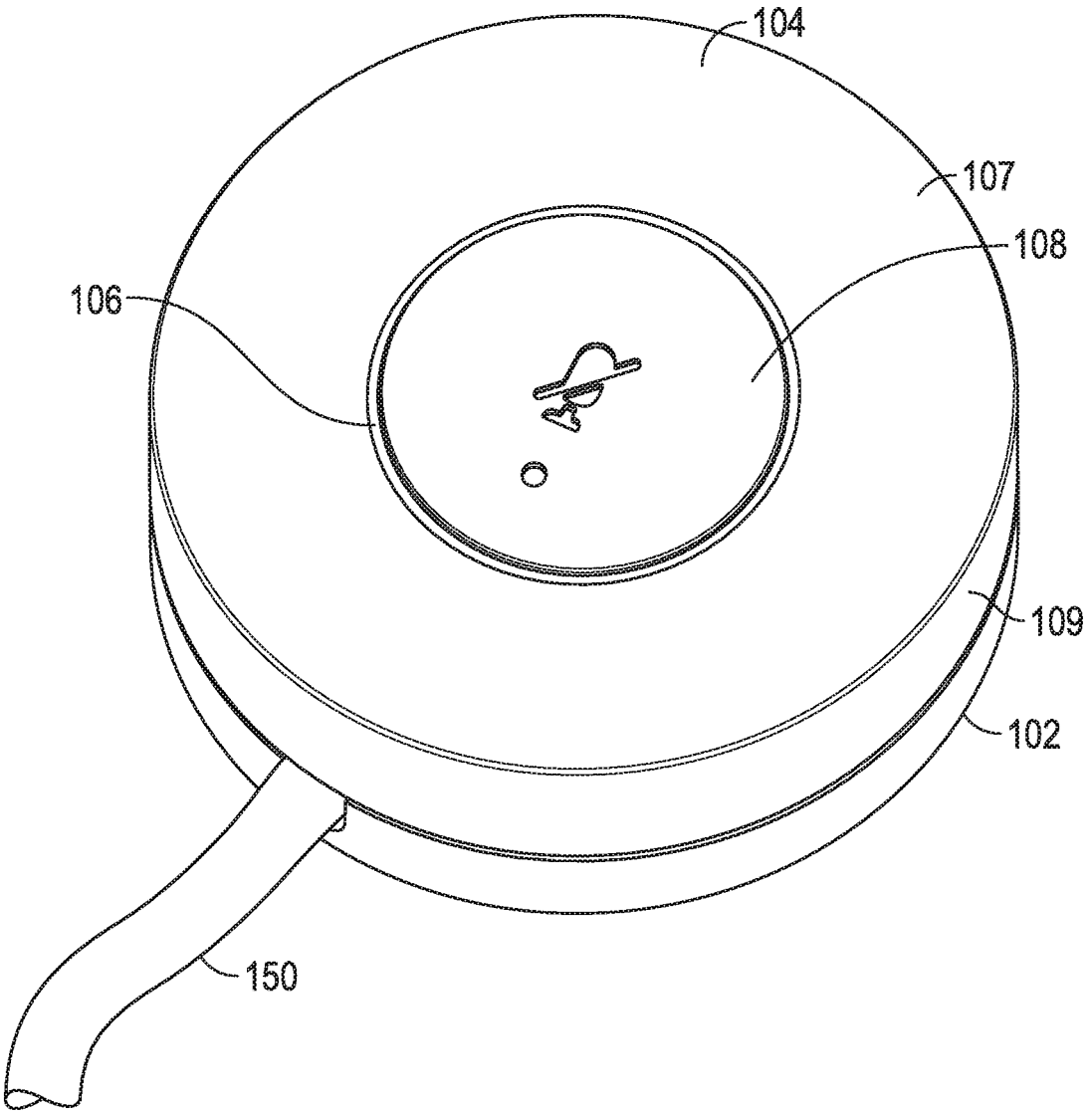
FIG. 1 illustrates an isometric view of an example embodiment of a satellite microphone assembly.

A satellite microphone assembly for use in teleconferencing or other audio based communications. The teleconference or other audio based communications can include one or more satellite microphone assemblies distributed around a conference room or communication area. The satellite microphone assembly includes a base housing a microphone and a volume control electronics. An outer ring can be coupled with the base and rotatable about and relative to the base. The outer ring can have a center aperture formed therein and a sidewall configured to be engaged by a user so that a user can rotate the outer ring. An actuatable button can be disposed within the center aperture of the outer ring to toggle between a mute/unmute configuration of the microphone. A rotational sensor can be supported by and received by the base to detect a rotation of the outer ring and output information about a direction and a degree of rotation of the outer ring to the volume control electronics. The detected direction and degree of rotation of the outer ring can affect a volume of a speaker disposed within the satellite microphone assembly and/or the teleconferencing/audio communication device.

EXAMPLE EMBODIMENTS

The present technology is described with reference to the attached figures, wherein like reference numerals are used throughout the figures to designate similar or equivalent elements. The figures are not drawn to scale and they are provided merely to illustrate the instant technology. Several aspects of the technology are described below with reference to example applications for illustration. It should be understood that numerous specific details, relationships, and methods are set forth to provide a full understanding of the technology. One having ordinary skill in the relevant art, however, will readily recognize that the technology can be practiced without one or more of the specific details or with other methods. In other instances, well-known structures or operations are not shown in detail to avoid obscuring the technology. The present technology is not limited by the illustrated ordering of acts or events, as some acts may occur in different orders and/or concurrently with other acts or events. Furthermore, not all illustrated acts or events are required to implement a methodology in accordance with the present technology.

Several definitions that apply throughout this disclosure will now be presented. The terms "comprising," "including" and "having" are used interchangeably in this disclosure. The terms "comprising," "including" and "having" mean to include, but are not necessarily limited to, the things so described.

The term "coupled with" is defined as connected, either directly or indirectly through intervening components, and the connections are not necessarily limited to physical connections, but are connections that accommodate the transfer of data between the so-described components. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

FIG. 1 illustrates an exterior isometric view of an example embodiment of a satellite microphone assembly 100 for use in teleconferencing or other audio communication systems. One or more satellite microphone assemblies may be communicatively linked to a base station (not pictured) via a connecting cable 150, which can supply electrical power and transmit data between the base station and satellite microphone assembly 100. In some embodiments, a wireless connection may be used for the transmission of data between the base station and satellite microphone assembly 100. The wireless connection can be implemented with BlueTooth®, WiFi, or any other wireless technology suitable for audio transmission. In wireless implementations, the microphone assembly 100 can include a battery source which may be user replaceable and/or rechargeable.

The satellite microphone assembly can include a base 102 and a rotatable outer ring 104 coupled with the base 102. The outer ring 104 can include a center aperture 106 and substantially enclose the base 102 and be continuously rotatable relative to the base 102 in both a clockwise and a counter-clockwise direction. Rotation of the cylindrical top portion about the base portion is configured to adjust the volume of a speaker, which is typically contained in the base 102, though in some instances at least one speaker can also contained in the satellite microphone assembly 100. For example, rotation of outer ring 104 in a clockwise direction may cause the volume of the speaker to be increased, while rotation of outer ring 104 in a counter-clockwise direction may cause the volume of the speaker to be decreased. A volume indicator 140 can be further provided in order to indicate the current or user-selected volume level of the speaker, and in some embodiments, may be provided as one or more LEDs or other lighting elements.

The outer ring 104 can have a top surface 107 and a sidewall surface 109. Rotational force can be applied to either the top surface 107 or the sidewall surface 109 allowing a user to adjust volume of the satellite microphone assembly 100 from numbers positions and/or grips. In some embodiments, the outer ring 104 can be independent of the top surface 107 and be configured to receive rotational input only from the sidewall surface 109. In other embodiments, the outer ring 104 can be independent of the sidewall surface 109 and be configured to receive rotational input only from the top surface 107.

The satellite microphone assembly can include a button assembly 108 disposed within the center aperture 106 of the outer ring 104. The button assembly 108 can be configured to toggle the satellite microphone assembly 100 between an unmuted configuration and a muted configuration without rotation of the outer ring 104. In at least one embodiment, the button assembly 108 can be actuatable allowing a physical response when toggling between the unmuted/muted configurations. In other embodiments the button assembly 108 can be a touch sensitive button requiring no physical response when toggling between the unmuted/muted configurations.

The button assembly 108 can be communicatively coupled with the volume indicator 140 providing an indication between the unmuted configuration and the muted configuration. The volume indicator 140 displays a first predetermined indication during the muted configuration and a second predetermined indication during the unmuted configuration. In at least one embodiment, the volume indicator 140 can display a plurality of red LEDs or other lighting elements in the muted configuration and a plurality of green LEDs or other lighting elements in the unmuted configuration. This is described in further detail below with respect to a mute indicator 130

Figure 2:
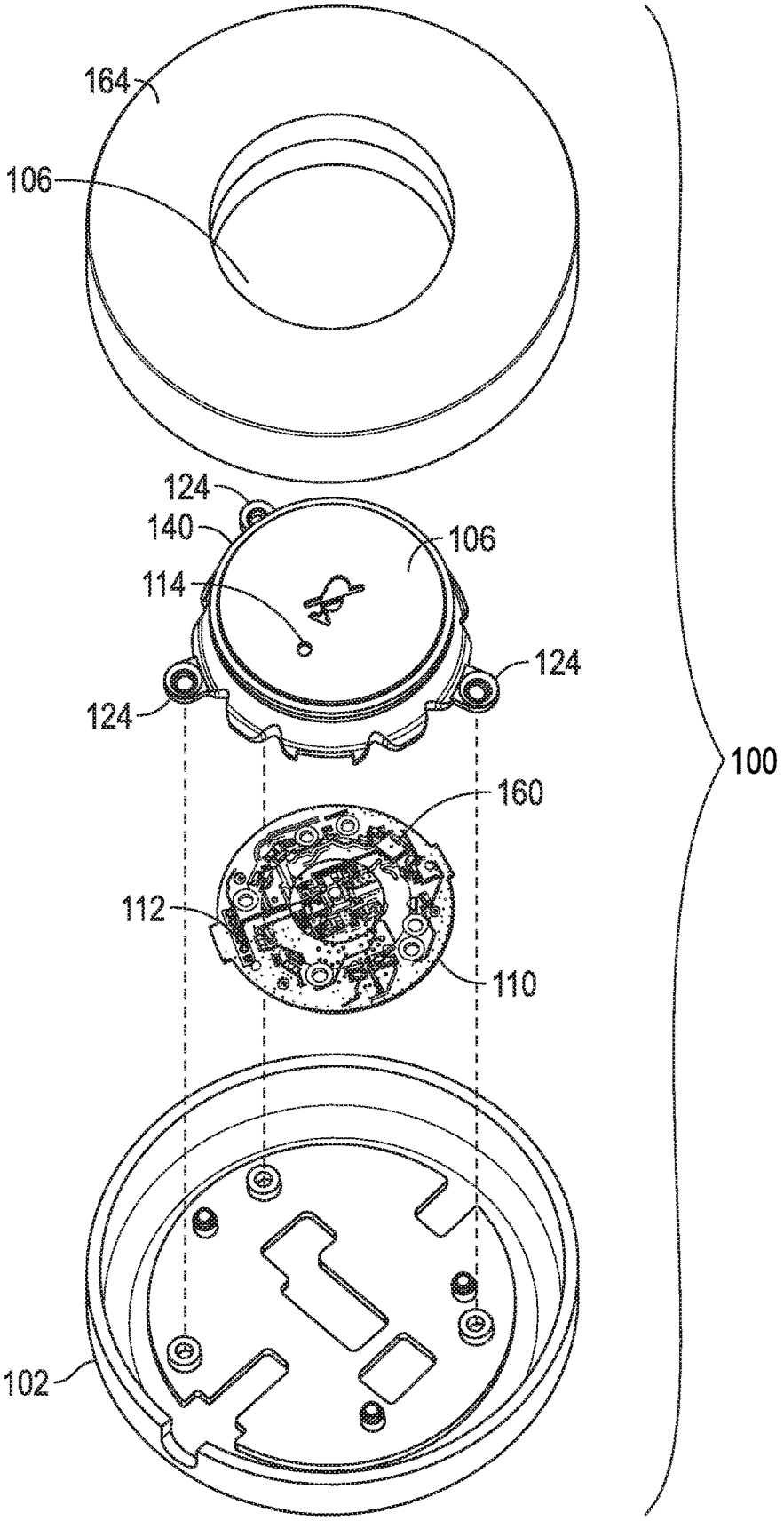
FIG. 2 illustrates an top isometric view of a ring assembly of a satellite microphone assembly.

FIG. 2 illustrates an exploded view of a satellite microphone assembly according to the present disclosure. The satellite microphone assembly 100 can include the outer ring 104, the button assembly 106, a volume control electronics 108, and the base 102. The outer ring 104 and the base 102 can collectively house the button assembly 106 and the volume control electronics 110. The volume control electronics 110 can be a printed circuit board (PCB) having one or more components disposed thereon including, but not limited to, memory, Read Only Memory (ROM), Random Access Memory (RAM), cache, a processor, accelerometer, and other related components.

A microphone element 112 can be communicatively coupled with the volume control electronics 110 and be similarly housed within the base 102. In at least one embodiment, the microphone element 112 can be disposed on the volume control electronics 110. In other embodiments the microphone element 112 can be located remote from the volume control electronics 110.

The button assembly 108 can be configured to receive at least a portion of the microphone element 112 for improved audio quality. The button assembly 108 can have one or more apertures 114 formed therein, the buttons aligning with the microphone element 112 or providing improved sound passage through the satellite microphone assembly 100.

Rotation of the outer ring 104 relative to the base 102 can be detected by a rotational sensor 160, which outputs information about the direction and degree of rotation to the volume control electronics 110. Rotational sensor 160 can be mounted within the base 102, thereby allowing detection of rotation of the outer ring 104 relative to the base 102. In at least one embodiment, the rotational sensor 160 can be an accelerometer. In other embodiments, the rotation of the outer ring 104 can be detected mechanically, through the use of devices such as potentiometers or other control knobs, as would be appreciated by persons of ordinary skill in the art.

The rotational sensor 160 outputs rotation data to volume control electronics 110, thereby detecting either a resting state or a movement state of satellite microphone assembly 100. Persons of ordinary skill in the art would appreciate that rotational sensor 160 may be located anywhere within the satellite microphone assembly 100 so long as it is communicatively linked to the volume control electronics 110. In a resting state of satellite microphone assembly 100, rotational sensor 160 may detect zero or minimal movement/acceleration, ignoring any effects of gravity. For example, a resting state might correspond to satellite microphone assembly 100 resting flat on a table. In a resting state, volume control electronics 110 are enabled and operative to capture input to the outer ring 104. The resting state may be determined instantaneously or determined over some pre-defined period of time. In the resting state, satellite microphone assembly 100 functions normally and as described above.

Upon receipt of the information about the direction and degree of rotation, volume control electronics 110 can adjust the volume of the speaker and also update the volume indicator 140 to indicate a new selected volume level of the speaker.

However, if satellite microphone assembly 100 is picked up or otherwise physically moved, particularly during an active phone call or other audio transmission session, one or more of the mute function and the volume level adjustment function may be inadvertently toggled or otherwise engaged. Such control inputs are undesirable, and as such, rotational sensor 160 is configured to detect a moving state of satellite microphone assembly 100 and disable volume control electronics 110. A moving state is generally understood to correspond to a translational velocity along one or more of the axes of detection of rotational sensor 160, wherein movement in the direction of each axis is either not currently substantially equal to zero or has not remained substantially equal to zero for some pre-defined period of time. By disabling volume control electronics 110, any inadvertent input will be ignored, and no mute or volume adjustments may be made until the satellite microphone assembly 100 returns to a resting state. In some embodiments, it may be possible to disable this feature of satellite microphone assembly 100 and simply keep volume control electronics 110 in a constantly enabled state.

Figure 3:
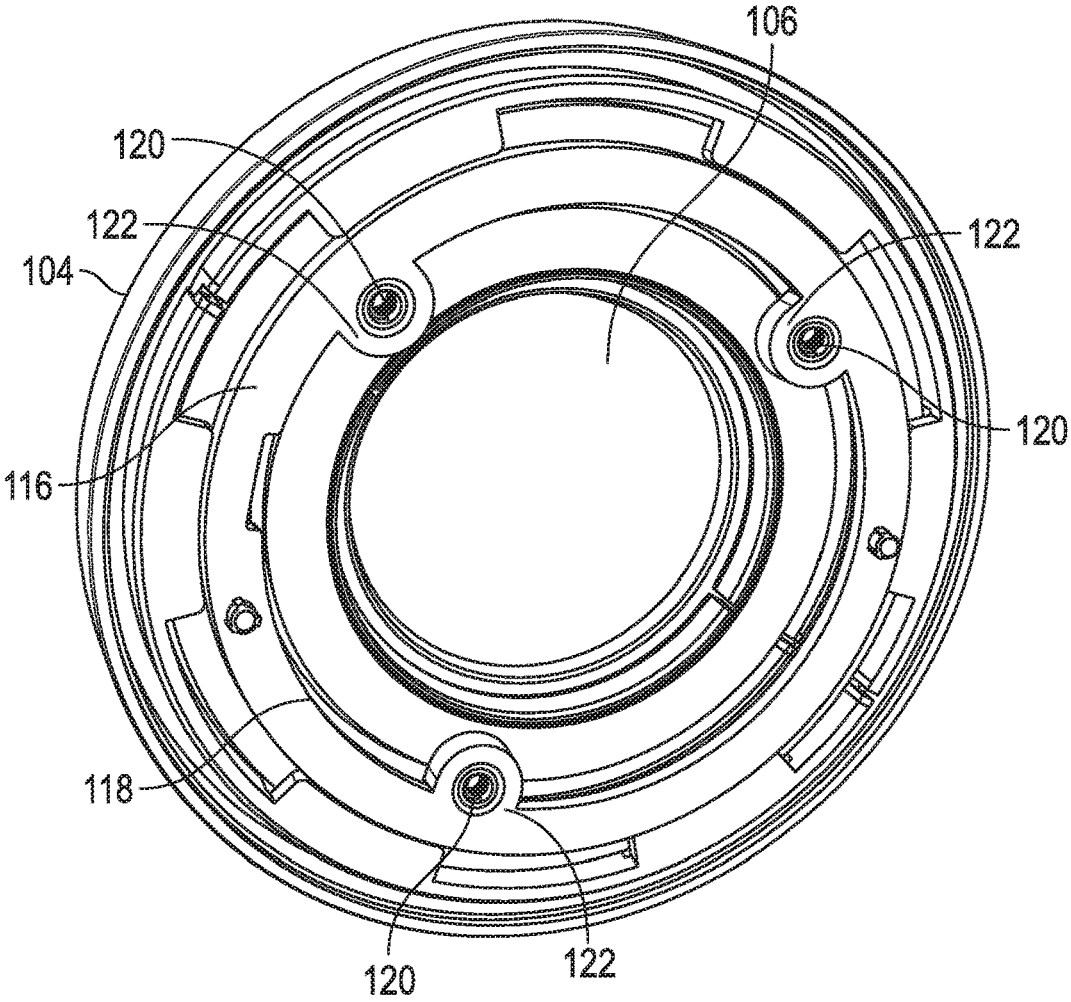
FIG. 3 illustrates a bottom isometric view of a ring assembly of a satellite microphone assembly.
Figure 4:
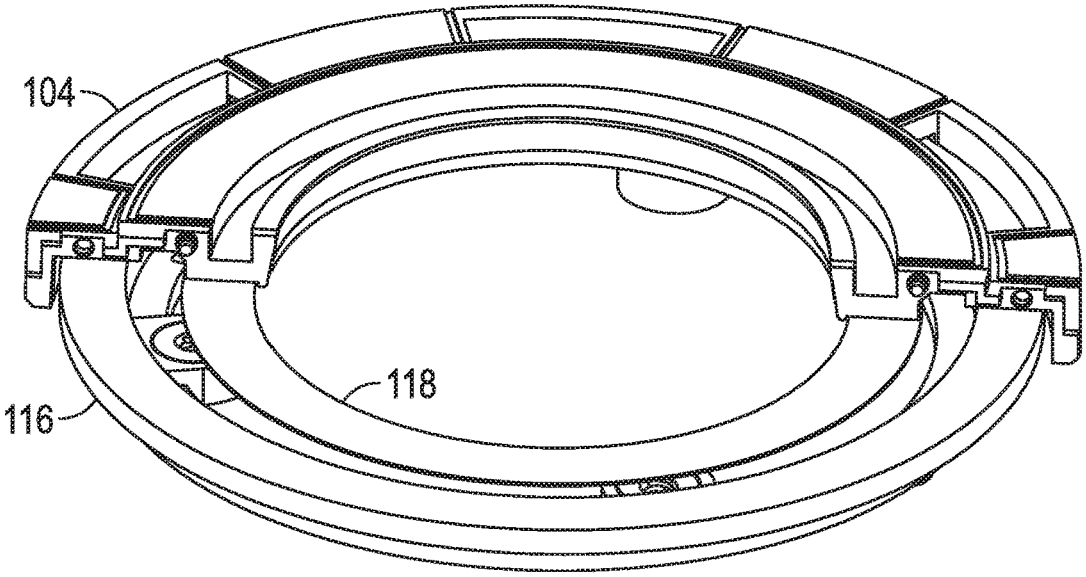
FIG. 4 illustrates a cross-section view of a ring assembly of a satellite microphone assembly.

FIG. 3 illustrates a bottom isometric view of a ring assembly of a satellite microphone assembly according to the present disclosure. FIG. 4 illustrates a cross-sectional view of a ring assembly of a satellite microphone assembly. The outer ring 104 can be disposed over and substantially around an inner ring 116. The inner ring 116 can have a center aperture 118 at least substantially the same as the center aperture 106 formed in the outer ring 104 and having a substantially aligned center point. The inner ring 116 can have a plurality of fastener apertures 120 formed therein. The plurality of fastener apertures 120 can be configured receive a plurality of fasteners (not shown) to couple the inner ring 116 with the base 102. In at least one embodiment, the plurality of fastener apertures 120 can be threaded apertures configured to receive a threaded fastener (for example, a screw), thereby coupling the base 102 with the inner ring 116. In other embodiments the plurality of fastener apertures 120 can be through apertures configured to receive push-pin connectors coupling the base 102 with the inner ring 116.

The outer ring 104 can be rotatable relative to the inner ring 116 and the base 102. The outer ring 104 can be disposed over the inner ring 116 allowing the outer ring 104 to be rotated while the inner ring 116, button assembly 108, and the base 102 remain stationary.

The inner ring 116 can include one or more protrusions 122 inwardly extended toward the center aperture 118. The one or more protrusions 122 can be configured to engage with the button assembly 108 and impeding rotation of the button assembly 108 relative to the outer ring 104.

Figure 5:
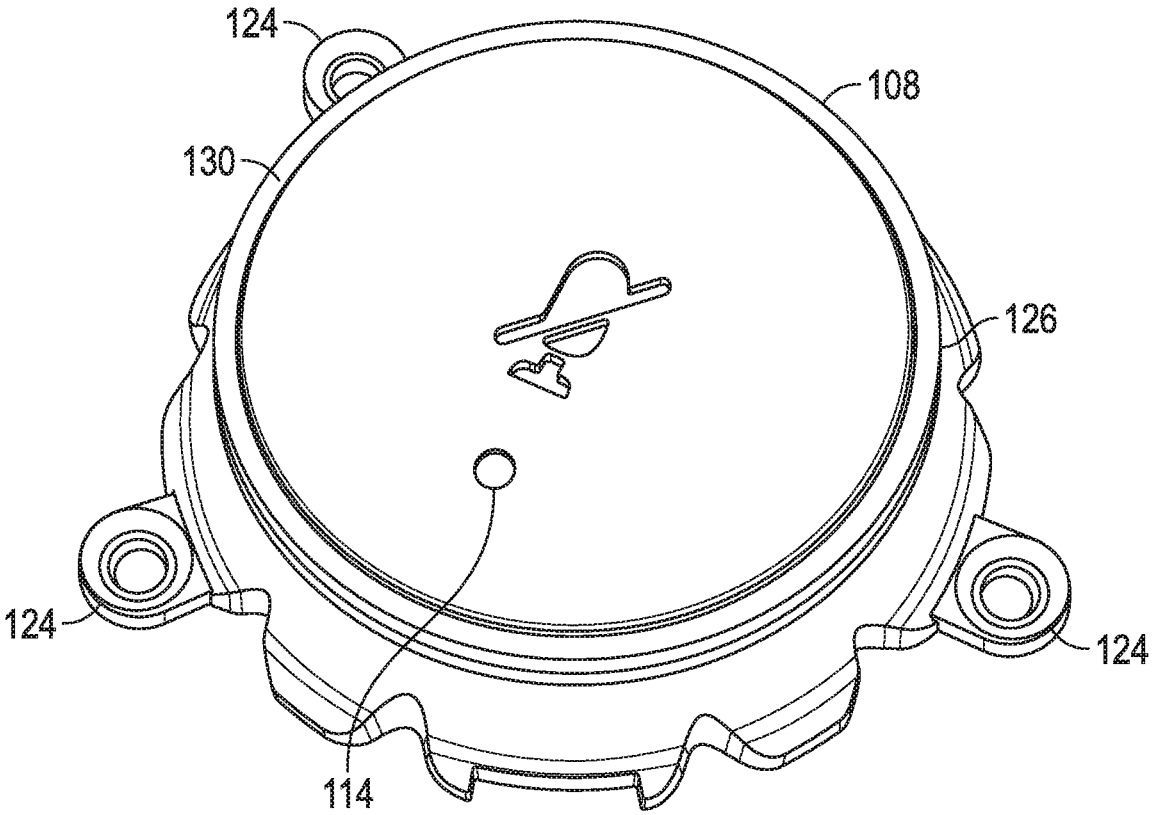
FIG. 5 illustrates a top elevational view of an example embodiment for a mechanism to capture a received user touch or user press for toggling a mute/unmute state of a microphone.

FIG. 5 illustrates a top elevational view of a button assembly of a satellite microphone assembly. The button assembly 108 can have one or more corresponding protrusions 124 configured to engage with the one or more protrusions 122 formed on the inner ring 116. The one or more corresponding protrusions 124 can be formed along a circumferential edge 126 of the button assembly 108 and arranged to reduce backlash between the one or more protrusions and the one or more corresponding protrusions 124 during rotation. The reduction and/or elimination of backlash can eliminate tactile feedback, thus allowing rotation in both a clockwise and counter-clockwise direction without tactile feedback, such as slippage during change of direction, to the user.

While FIGS. 3 and 5 detail the one or more protrusions 122 and the one or more corresponding protrusions 124 as extending away respective surfaces, it is within the scope of this disclosure to implement one of the one or more protrusions 122 or the one or more corresponding protrusions 124 as a groove configured to receive the other of the one or more protrusions 122 or the one or more corresponding protrusions 124. The protrusion/groove arrangement can similarly reduce and/or eliminate the backlash of rotation between the outer ring 104 and the base 102. In at least one embodiment, the one or more corresponding protrusions 124 can be grooves formed in the circumferential edge 126 of the button assembly 108.

In some embodiments, the button assembly 108 can be actuatable and displaceable relative to the outer ring 104. In other embodiments the button assembly 108 can be a touch interface having a surface detecting user interaction through capacitance or other touch capabilities.

Figure 6:
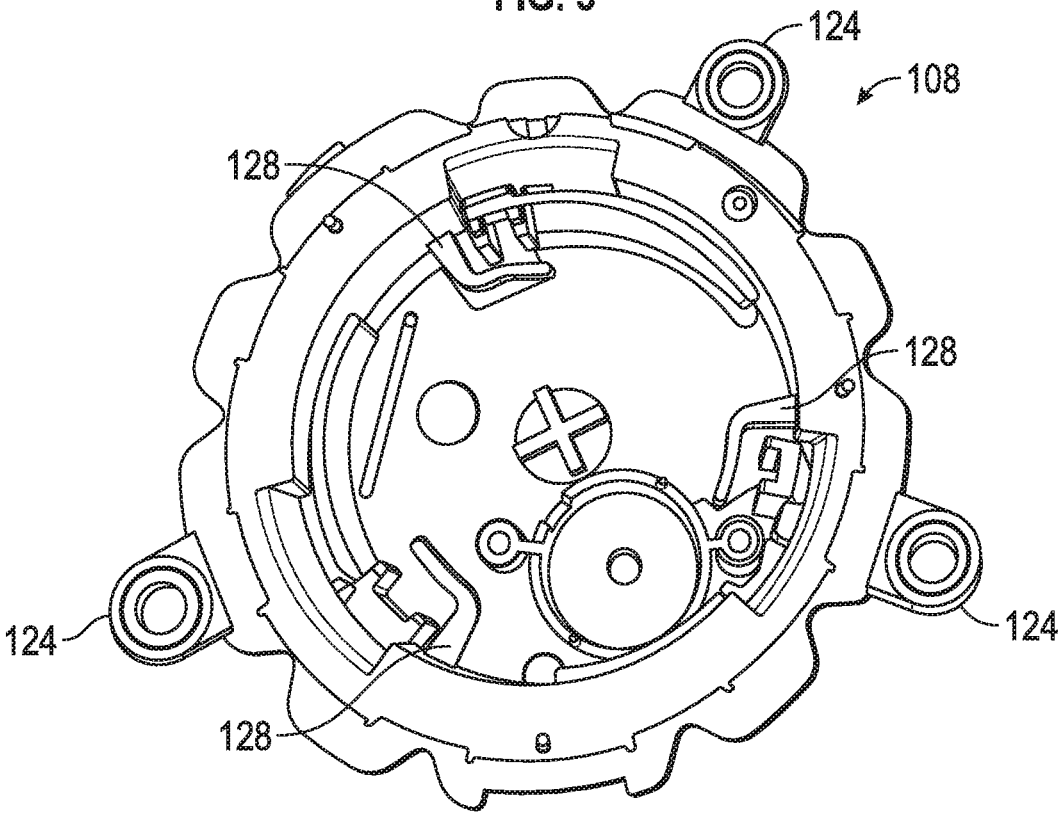
FIG. 6 illustrates a bottom elevational view of an example embodiment for a mechanism to capture a received user touch or user press for toggling a mute/unmute state of a microphone.

FIG. 6 illustrates a bottom assembly elevational view of a button assembly of a satellite microphone assembly. The button assembly 108 can be an actuatable button to toggle a mute/unmute function of a microphone element 112, whereby a received user touch or user press of button assembly 108 engages the actuatable button function. The button assembly 108 can include a biasing element 128 configured to bias an actuatable button to a first position and return the actuatable button to the first position after actuation of the toggle. The biasing element 128 can be a spring, actuator, or flexible displaceable material. As can be appreciated in FIG. 6, the biasing element 128 can be A mute indicator 130 indicates the mute/unmute status of the microphone and can be provided as an LCD display, or LED lighting element, for example. In some embodiments, the outer ring 104 or the button assembly 108 can be configured to receive a user touch or press. In further embodiments, only button assembly 108 can be configured to receive a user touch or press. The mute indicator 130 can be at least a portion of the button assembly 108. In at least one embodiment, the mute indicator 130 is a illumination pipe circumferentially disposed around the button assembly 108 and receive light from an LED on the volume control electronics 110, for example green light in an unmuted configuration and red light in a muted configuration. In other embodiments, the button assembly 108 can be a light pipe receiving like from an LED on the volume control electronics 110.

As can be appreciated in FIGS. 5 and 6, the button assembly 108 can have one or more apertures 114 formed therein to improve or otherwise increase sound communication between the microphone element 112 and the user. In some embodiments, the microphone element 112 can be disposed within the one or more aperture 114 formed in the button assembly 108. In other embodiments, the microphone element 112 can be remotely located away from the one or more apertures 114 but within it audio communication of the one or more aperture 114.

In some embodiments, the mute indicator 130 and the volume indicator 140 can be the same element including a common light pipe and lighting element. In other embodiments, the mute indicator 130 and the volume indicator 140 can be separate light elements sharing a common light pipe or light display. In yet other embodiments, the mute indicator and the volume indicator 140 can be completely independent of one another having separate lighting elements and separate light displays and/or light pipes.

When a sufficiently forceful received user touch or press of button assembly 108 is registered, the actuatable button is displaced downwards, closer to base 104, and causes a signal to be sent to volume control electronics 110 indicative that button assembly 108 has been actuated. Upon receipt of this actuation signal, volume control electronics 110 toggles the mute/unmute status of microphone element 112 and may also correspondingly update volume indicator 140.

Figure 7:
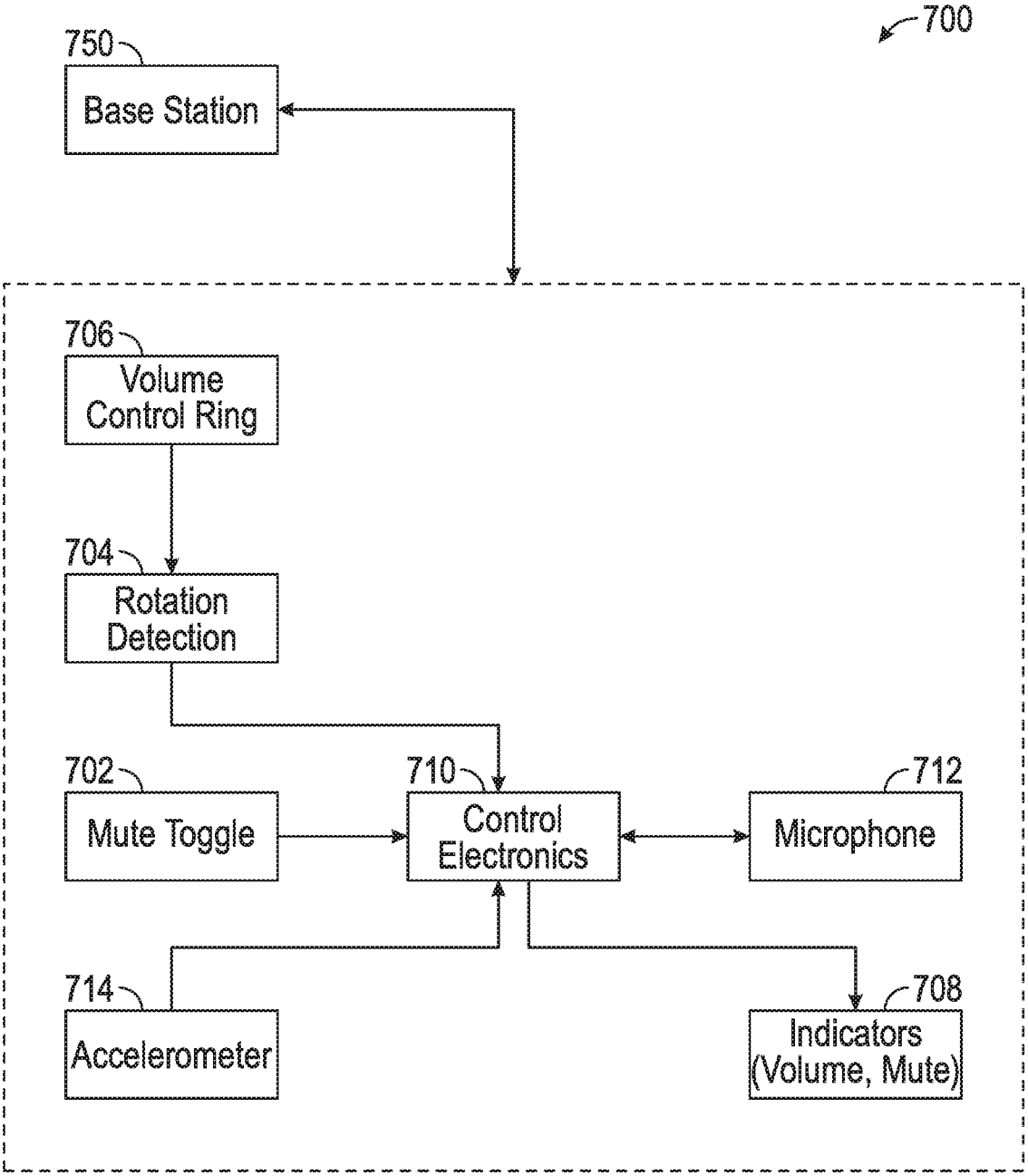
FIG. 7 illustrates a block diagram of an example satellite microphone assembly and the connections between its constituent components.

FIG. 7 illustrates a block diagram of an example satellite microphone assembly 700, with its constituent components contained within the dotted lines. A base station 750 is communicatively linked with satellite microphone assembly 700, as indicated by the directionality of the arrow linking these two systems. At the center of satellite microphone assembly 700 is a control electronics 710, which may contain one or more processors for receiving, analyzing, and transmitting data and commands or instructions. A mute toggle 702 is linked to transmit data to control electronics 710 indicative of an input to toggle the mute/unmute status of a microphone 712, wherein the input may comprise the actuation of a push button. Mute toggle 702 may use mechanical means, electrical means, or some combination thereof to receive input. Upon receipt of an input to toggle the mute/unmute status of microphone 712, control electronics 710 transmits a signal to toggle the mute/unmute status of microphone 712 and additionally may update a visual indicator 708 such as an external display or status light.

A volume control ring 706 is used to receive input for a volume adjustment level, and may use mechanical means, electrical means, or some combination thereof to receive input. A rotation detection mechanism 704 monitors volume control ring 706 and determines a direction and degree of rotation of volume control ring 706, and may be implemented as an optical sensor or a rotary knob in some embodiments. Rotation detection mechanism 704 outputs information about the direction and degree of rotation of volume control ring 706 to volume control electronics 710, which uses this information to make corresponding updates in the volume level and additionally may update a visual indicator 708 such as one or more external displays or status lights.

When an input is received at control electronics 710 from either rotation detection mechanism 704 or mute toggle 702, control electronics 710 sends a signal to generate tactile feedback to a haptic actuator 716. Haptic actuator 716 outputs one or more types of vibrations to provide tactile feedback for at least one of a volume level adjustment and a mute toggle. In various embodiments, haptic actuator 716 may be replaced or supplemented with mechanical means of providing tactile feedback, such as a detent mechanism.

An accelerometer 714 may detect one of a resting state or a moving state of satellite microphone assembly 700 and output data to control electronics 710. Responsive to the detection of a resting state, control electronics 710 remain enabled, and responsive to the detection of a moving state, control electronics 710 are disabled for the duration of the moving state. In a resting state of satellite microphone assembly 500, accelerometer 714 may detect zero or minimal acceleration, ignoring any effects of gravity. The resting state may be determined instantaneously or determined over some pre-defined period of time. A moving state is generally understood to correspond to a translational velocity along one or more of the axes of detection of accelerometer 714, wherein acceleration in the direction of each axis is either not currently substantially equal to zero or has not remained substantially equal to zero for some pre-defined period of time. In some embodiments, it may be possible to disable this feature of satellite microphone assembly 700 and simply keep control electronics 710 in a constantly enabled state.

Microphone 712 is communicatively linked with control electronics 710, as two-way communication is required for microphone 712 to transmit captured audio data and for control electronics 710 to transmit control signals to toggle the mute/unmute status of microphone 712. In some embodiments, one or more of base station 750, control electronics 710, and microphone 712 may be adapted to perform signal processing on the audio stream captured at microphone 712, for example to remove background or otherwise undesirable noise. Microphone 712 may record noise generated by haptic actuator 716 or a detent mechanism as tactile feedback is provided for a volume level adjustment, or microphone 712 may record noise generated by haptic actuator 716 or mute toggle 702 as tactile feedback is provided for a toggle of the mute/unmute status. Persons of ordinary skill in the art would appreciate that this signal processing may be performed in analog or digital fashion, and furthermore is not limited to be performed solely on the above identified examples of background noise, nor limited to be performed solely at one or more of the three identified hardware locations.

Figure 8:
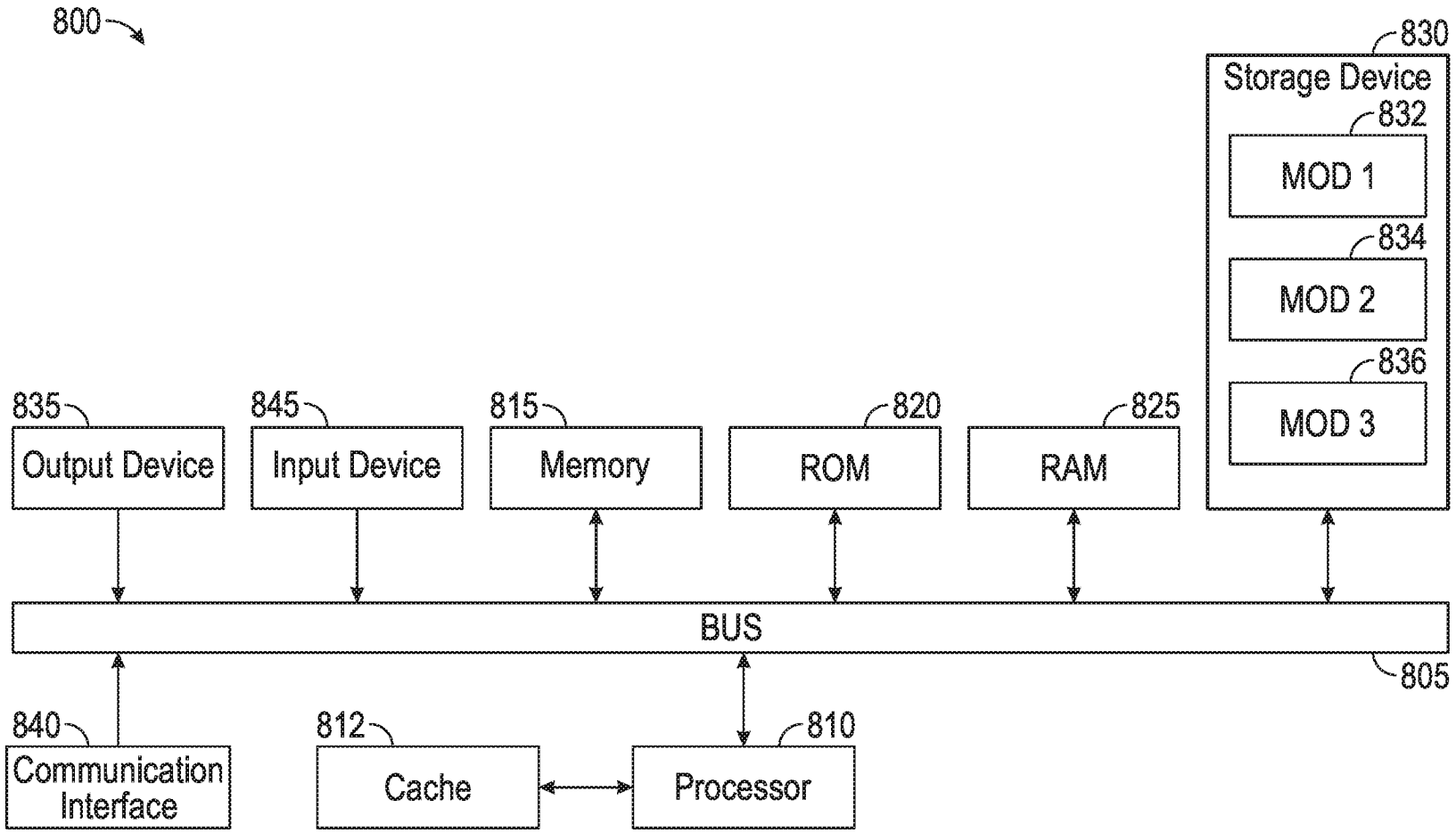
FIG. 8 illustrates a system bus computing system architecture for use in the various embodiments described herein.

Some of the embodiments described herein rely on software in conjunction with hardware to carry out the described functions. It will be understood by those of ordinary skill in the art that a computing system such as illustrated in FIG. 8 can be used to store and execute software that is effective to receive inputs from hardware devices or instruct hardware device to provide outputs as described herein. As such FIG. 8 illustrates a system bus computing system architecture 800 wherein the components of the system are in electrical communication with each other using a bus 805. Exemplary system 800 includes a processing unit (CPU or processor) 810 and a system bus 805 that couples various system components including the system memory 815, such as read only memory (ROM) 820 and random access memory (RAM) 825, to the processor 810. The system 800 can include a cache of high-speed memory connected directly with, in close proximity to, or integrated as part of the processor 810. The system 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other system memory 815 may be available for use as well. The memory 815 can include multiple different types of memory with different performance characteristics. The processor 810 can include any general purpose processor and a hardware module or software module, such as module 1 832, module 2 834, and module 3 836 stored in storage device 830, configured to control the processor 810 as well as a special-purpose processor where software instructions are incorporated into the actual processor design. The processor 810 may essentially be a completely self-contained computing system, containing multiple cores or processors, a bus, memory controller, cache, etc. A multi-core processor may be symmetric or asymmetric.

To enable user interaction with the computing device 800, an input device 845 can represent any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art. In some instances, multimodal systems can enable a user to provide multiple types of input to communicate with the computing device 800. The communications interface 840 can generally govern and manage the user input and system output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 825, read only memory (ROM) 820, and hybrids thereof.

The storage device 830 can include software modules 832, 834, 836 for controlling the processor 810. Other hardware or software modules are contemplated. The storage device 830 can be connected to the system bus 805. In one aspect, a hardware module that performs a particular function can include the software component stored in a computer-readable medium in connection with the necessary hardware components, such as the processor 810, bus 805, display 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

While various embodiments of the present technology have been described above, it should be understood that they have been presented by way of example only, and not limitation. Numerous changes to the disclosed embodiments can be made in accordance with the disclosure herein without departing from the spirit or scope of the technology. Thus, the breadth and scope of the present technology should not be limited by any of the above described embodiments. Rather, the scope of the technology should be defined in accordance with the following claims and their equivalents.

Although the technology has been illustrated and described with respect to one or more implementations, equivalent alterations and modifications will occur to others skilled in the art upon the reading and understanding of this specification and the annexed drawings. In addition, while a particular feature of the technology may have been disclosed with respect to only one of several implementations, such feature may be combined with one or more other features of the other implementations as may be desired and advantageous for any given or particular application.

The terminology used herein is for the purpose of describing particular embodiments only and is not intended to be limiting of the technology. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this technology belongs. Also, the terms "about", "substantially", and "approximately", as used herein with respect to a stated value or a property, are intend to indicate being within 20% of the stated value or property, unless otherwise specified above. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A satellite microphone assembly comprising:

a base housing a microphone and a volume control electronics;

an outer ring coupled with the base and rotatable about the base, the outer ring having a center aperture and a sidewall configured to be engaged by a user so that a user can rotate the ring;

an actuatable button disposed within the center aperture of the outer ring to toggle mute/unmute of the microphone;

an rotational sensor supported by the base, the rotational sensor configured to detect a rotation of the outer ring and to output information about a direction and a degree of rotation of the outer ring to the volume control electronics, and cause a rotation of the outer ring to affect a volume of a speaker;

an inner ring coupled with the base, the outer ring disposed over the inner ring and rotatable relative to the inner ring and the base, wherein the inner ring and the base are stationary; and the inner ring has one or more protrusions inwardly extending toward the center aperture and the actuatable button has one or more corresponding protrusions engaged with the one or more protrusions, thereby securing the actuatable button stationary relative to the outer ring.

2. The satellite microphone assembly of claim 1, wherein the one or more protrusions and the one or more corresponding protrusions are arranged to reduce backlash.

3. The satellite microphone assembly of claim 1, wherein the actuatable button includes a microphone port communicatively coupled with the microphone housed in the base.

4. The satellite microphone assembly of claim 1, wherein the rotational sensor is an accelerometer detecting rotational speed of the outer ring relative to the base.

5. A rotational assembly, comprising:

a base housing control electronics;

an inner ring securely coupled with the base, the inner ring having a center aperture;

an outer ring disposed over the inner ring and rotatable about the relative to the inner ring, the outer ring having a center aperture, the center aperture of the outer ring having a larger diameter than the center aperture of the inner ring;

a button disposed within the center aperture of the outer ring; and a rotational sensor supported by the base, the rotational sensor configured to detect a rotation of the outer ring relative to the base, the rotational sensor outputting information about a direction and a degree of rotation of the outer ring to the control electronics;

wherein the inner ring has one or more protrusions inwardly extending toward the center aperture and the button has one or more corresponding protrusions engaged with the one or more protrusions, thereby securing the button stationary relative to the outer ring.

6. The rotational assembly of claim 5, wherein one or the one or more protrusions of the inner ring and the one or more corresponding protrusions of the button are grooves and the other of the one or more protrusions of the inner ring and the one or more corresponding protrusions of the button are protrusions, thereby forming a tongue and groove arrangement.

7. The rotational assembly of claim 5, wherein the rotational sensor is an accelerometer detecting rotational speed of the outer ring relative to the base.

8. The rotational assembly of claim 7, wherein the accelerometer detecting movement of the base signals the control electronics to disable one or more features of the button.

9. The rotational assembly of claim 5, wherein the button is an actuatable button and includes a biasing element configured to return the actuatable button to a first position after removal of an actuation force.

10. The rotational assembly of claim 5, wherein the button is a touch sensitive button requiring no physical response.

11. A satellite microphone system comprising:

a base communication device having at least one microphone and at least one speaker, the base communication device coupled with at least one satellite microphone assembly, the satellite microphone assembly comprising:

a base housing a microphone and a volume control electronics;

an outer ring coupled with the base and rotatable about the base, the ring having a center aperture and a sidewall configured to be engaged by a user so that a user can rotate the ring;

an actuatable button disposed within the center aperture of the ring to toggle mute/unmute of the microphone;

an rotational sensor supported by the base, the rotational sensor configured to detect a rotation of the cylinder and to output information about a direction and a degree of rotation of the cylinder to the volume control electronics, and cause a rotation of the cylinder to affect a volume of the speaker;

an inner ring coupled with the base, the outer ring disposed over the inner ring and rotatable relative to the inner ring and the base, wherein the inner ring and the base are stationary; and the inner ring has one or more protrusions inwardly extending toward the center aperture and the actuatable button has one or more corresponding protrusions engaged with the one or more protrusions, thereby securing the actuatable button stationary relative to the outer ring.

12. The satellite microphone system of claim 11, wherein the one or more protrusions and the one or more corresponding protrusions are arranged to reduce backlash.

13. The satellite microphone system of claim 11, wherein the actuatable button includes a microphone port communicatively coupled with the microphone housed in the base.

14. The satellite microphone system of claim 11, wherein the rotational sensor is an accelerometer detecting rotational speed of the outer ring relative to the base.

* * * * *